US007281645B2

(12) United States Patent
Cho

(10) Patent No.: US 7,281,645 B2
(45) Date of Patent: Oct. 16, 2007

(54) GLOVE SHAPING DEVICE

(76) Inventor: Chang-Yul Cho, 428-1, DunChon-Dong, KangDong-Ku, Seoul (KR) 134-060

( * ) Notice: Subject to any disclaimer, the term of this patent is extended or adjusted under 35 U.S.C. 154(b) by 34 days.

(21) Appl. No.: 10/522,379

(22) PCT Filed: Nov. 5, 2003

(86) PCT No.: PCT/KR03/02347

§ 371 (c)(1),
(2), (4) Date: Mar. 7, 2005

(87) PCT Pub. No.: WO2004/044304

PCT Pub. Date: May 27, 2004

(65) Prior Publication Data

US 2005/0274750 A1 Dec. 15, 2005

(30) Foreign Application Priority Data

Nov. 9, 2002 (KR) ..... 10-2002-0069484
Aug. 28, 2003 (KR) ..... 20-2003-0027718 U

(51) Int. Cl.
*A41D 1/06* (2006.01)

(52) U.S. Cl. ..... 223/79; 223/78

(58) Field of Classification Search ..... 223/78–79; 623/57–65

See application file for complete search history.

(56) References Cited

U.S. PATENT DOCUMENTS

| | | | | |
|---|---|---|---|---|
| 460,023 | A * | 9/1891 | Merrill | 223/78 |
| 1,369,341 | A * | 2/1921 | Kearns | 223/78 |
| 4,084,733 | A * | 4/1978 | Perlmutter | 223/78 |
| 4,199,089 | A * | 4/1980 | Filkow et al. | 223/79 |
| 4,398,364 | A * | 8/1983 | Augustine et al. | 38/77.5 |
| 4,472,836 | A * | 9/1984 | Shikatani | 2/169 |
| 5,115,580 | A | 5/1992 | Blumenfeld et al. | |
| 6,085,436 | A * | 7/2000 | Peet | 34/104 |

FOREIGN PATENT DOCUMENTS

| | | |
|---|---|---|
| JP | 55-146100 | 10/1980 |
| JP | 56-39422 | 4/1981 |
| JP | 05-168799 | 7/1993 |

* cited by examiner

*Primary Examiner*—Gary L. Welch
*Assistant Examiner*—Andrew W Sutton
(74) *Attorney, Agent, or Firm*—Jordan and Hamburg LLP

(57) ABSTRACT

Disclosed herein is a glove shaping device for heating and shaping the wrinkled and sewn portions of a glove. The glove shaping device includes a plurality of heating plates to be inserted into the finger portions of the glove. A body portion is provided in its interior with an electric heater and joint depressions in its top portion. A cover is attached to the heating plates and the body portion. Each of the heating plates is formed to have a rhomboid sectional shape, a predetermined thickness, two parallel side surfaces each inclined at a predetermined angle, and a joint prominence corresponding to a joint depression in a body portion.

2 Claims, 8 Drawing Sheets

GLOVE SHAPING DEVICE

BACKGROUND OF THE INVENTION

1. Field of the Invention

The present invention relates generally to a glove shaping device, and more particularly to a glove shaping device, which is capable of shaping a glove (golf gloves, dress gloves or sports gloves etc.) without wrinkles formed during the sewing process and has a temperature control unit to easily make a temperature of the device suitable one for various kinds of gloves.

2. Description of the Prior Art

In general, people wear gloves to protect their hands while carrying out manual work. Gloves are used in the various fields of industry or various types of sports. The gloves have various shapes depending on intended use and the type of material (e.g., natural leather, synthetic leather or textile).

Gloves are fabricated by cutting and sewing processes, but the gloves used for golf or formal occasions require another shaping processes (e.g., ironing) in accordance with their characteristics. Accordingly, in order to meet this requirement, some glove shaping devices have been used. Examples of such glove shaping devices currently used are shown in FIGS. 1 and 2 of the accompanying drawings.

First of all, the glove shaping device shown in FIG. 1 is developed and mainly used in Japan. This glove shaping device 1 comprises a plurality of elongated heating plates 4, in which their top edges are roundly-shaped and their lower portions are secured to one another by a plurality of screws 2.

The glove shaping device shown in FIG. 2 is developed and mainly used in the United States. This glove shaping device 1' comprises a plurality of heating plates 6 each having an oval sectional shape, coils 9 for heating the heating plates with certain temperature and a main body 8 having an electric heater (not shown) for generating heat.

Shaping processes utilizing the conventional glove shaping devices 1 and 1' described above are explained below. For the former device 1, heating plates 4 arranged and fixed by screws 2 are heated up to a certain temperature by using separate heating means (e.g., electric stove, heater, etc.), and then the wrinkled and sewn portions of a glove are shaped while the heating plates 4 are inserted into the finger portions of the glove.

For the latter device 1', coils 9 (and also heating plates 6) are heated up to a certain temperature by using the electric heater provided in the main body 8 and then the wrinkled and sewn portions of a glove formed during the cutting and sewing processes and shaped while the heating plates 6 are inserted into the finger portions of the glove.

However, the glove shaping device shown in FIG. 1 has the following drawbacks.

First, since a separate heating means is required to heat and shape the wrinkled and sewn portions of the glove, the work is troublesome and the work efficiency is lowered.

Second, since the heating plates that heat and shape the finger portions of the glove while being inserted into the finger portions are made in the form of overlapped sheets, contact between neighboring heating plates occurs.

Accordingly, the finger portions of the glove become overlapped with each other at their side edges, and the overlapped portions are overheated. Because of the overheating of the overlapped portions, the material (e.g., leather or textile) itself tightly adheres to the heating plates, or a deformation occurs. Further, the quality of the product becomes deteriorated.

Third, when the heating plates of the conventional glove shaping device are heated to a certain temperature by means of separate heating means, it is not possible to adjust the temperature of the heating plates to a certain temperature (e.g., leather: about 70-80° C., textile: about 150° C.).

Therefore, upon the overheating of the heating plates, the problems concerned with overheating as described above occur. When the heating plates are insufficiently heated to less than a certain temperature, the heating and shaping processes are not conducted smoothly, and the temperature of the heating plates are not kept constant but is lowered with time. The heating and shaping processes to the glove are not performed sufficiently. In this regard, the productivity of the conventional glove shaping device is lowered, and the power consumption of the conventional shaping device is high.

Fourth, since the heating plates, which are being heated to a relatively high temperature by separate heating means, are inserted into the finger portions of the glove, shaping work is difficult and the safety of the workers is not guaranteed. That is, accidents, such as a burn, may easily occur.

In the case of the glove shaping device shown in FIG. 2, it is possible to heat and keep the heating plates at a certain temperature by means of the electric heater provided in the main body, without separate heating means. For this reason, this shaping device has an advantage in heating and shaping the glove sufficiently.

However, since the heating plates of this conventional glove shaping device, which are inserted into the finger portions of the glove, each have an oval sectional shape, the wrinkled and sewn portions of the glove are shaped poorly, thereby deteriorating the quality of products and not meeting the user's expectations. Particularly, in the case of a golf glove, the glove does not fit closely to the fingers, so the sensitivity of the hand is reduced, thereby negatively affecting a user's game, such as by causing a putting irregularity.

SUMMARY OF THE INVENTION

Accordingly, the present invention has been made keeping in mind the above problems occurring in the prior art, and an object of the present invention is to provide a glove shaping device, which is capable of facilitating the adjustment of a heating temperature, providing a predetermined angle to the heating plates and minimizing the thickness of the shaping device when the wrinkled and sewn portions of the glove fabricated by cutting and sewing are heated and shaped, and have joint prominences and joint depressions which are intended to make assemble work easier and to improve strength and durability of a shaping device, thereby reducing the costs of manufacturing the glove shaping device and allowing a shaping operation to be easily performed, resulting in a reduction in the occurrence of inferior products and an improvement in the productivity of a glove manufacturing process.

In another aspect of the present invention, a shaping device is provided which has a top portion of a heating plate being a rounded-shape with a predetermined curvature in order to maintain a curve of a glove when a shaping process is finished.

In order to accomplish the above mentioned objects, the present invention provides a glove shaping device for heating and shaping the wrinkled and sewn portions of a glove, comprising a plurality of heating plates inserted into the finger portions of the glove, a body portion provided in its interior with an electric heater which has joint depressions on its top portion and a cover, wherein each of the heating plates is formed to have a rhomboid sectional shape, a predetermined thickness, two parallel side surfaces each inclined at a predetermined angle, and a joint prominence corresponding to a joint depression in a body portion. Also, a joint prominence in a heating plate and a joint depression in a body portion have a corresponding inclined plane at a predetermined angle respectively.

Furthermore, The present invention provides a glove shaping device further comprising a control unit with a temperature control lever; and a fixing unit placed on a top portion of a control unit, wherein said heating plates consist of the first heating plate, the second heating plate, the third heating plate and the fourth heating plate which have rounded-shapes being curved to one side with a predetermined curvature at their top portions and grooves to form spaces between two of said heating plates respectively.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
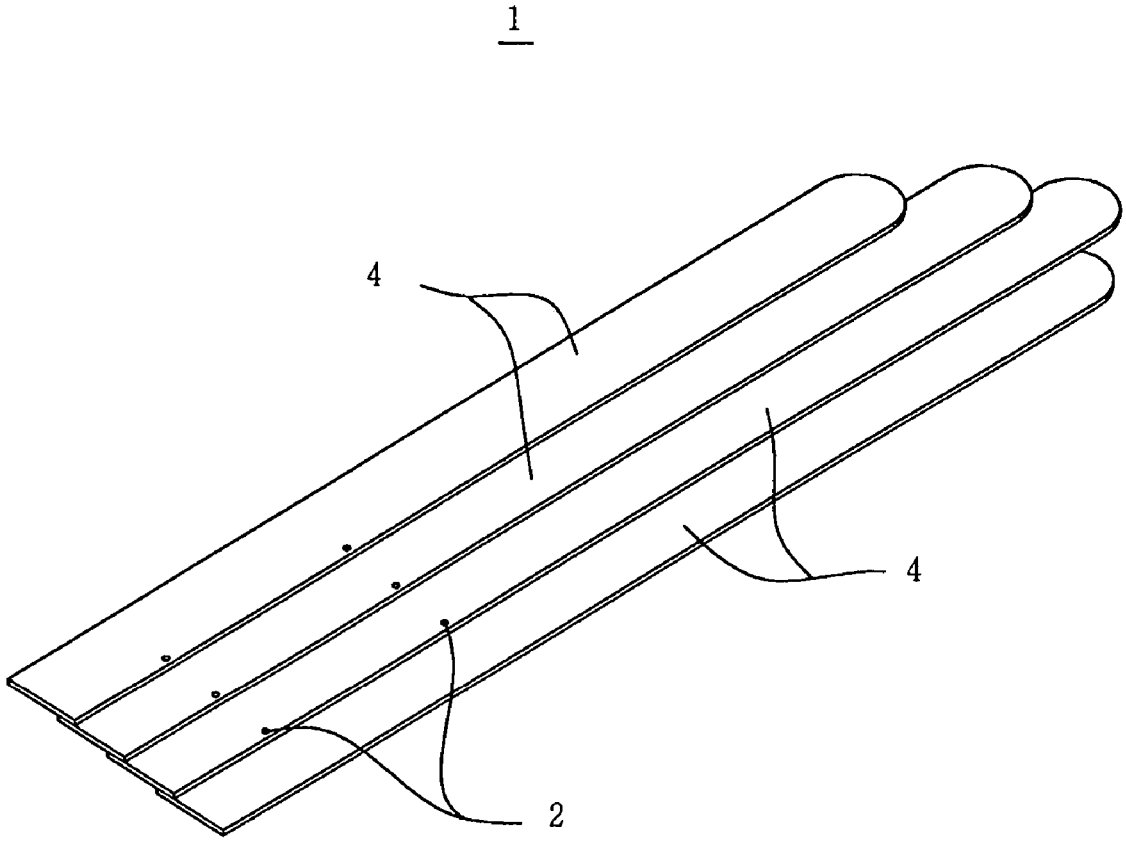
FIG. 1 is a schematic plan view of a conventional glove shaping device.
Figure 2:
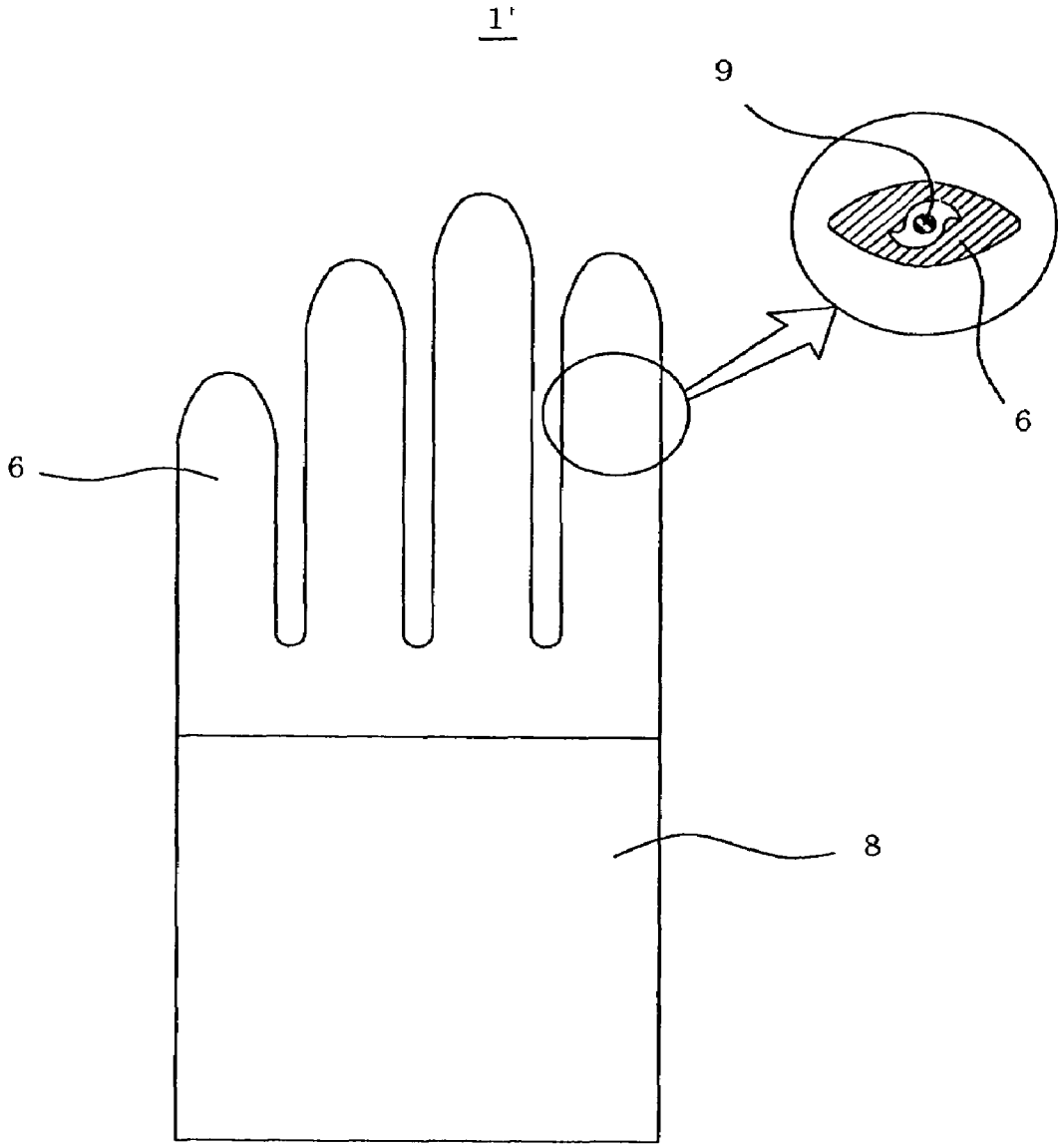
FIG. 2 is a schematic plan view of another conventional glove shaping device with its principal portion cross-sectioned.

Reference now should be made to the drawings, in which the same reference numerals are used throughout the different drawings to designate the same or similar components.

Referring to FIGS. 3 to 6, the glove shaping device 10 according to an embodiment of the present invention comprises a plurality of heating plates 30 to be inserted into the finger portions of a glove, a body portion 20 provided in its interior with an electric heater (not shown), and a cover 28. Each of the heating plates 30 is formed to have a rhomboid sectional shape, a thickness of t, and two parallel side surfaces each inclined at an angle of inclination $\theta_1$. A heating plate 30 has a joint prominence in its lower end and a body portion 20 has joint depressions in its top portion.

And a joint prominence in a heating plate 30 and a joint depression in a body portion 20 are formed with corresponding inclined planes 34, 24 at a predetermined angle $\theta_2$ respectively.

Preferably a predetermined thickness is 8 mm, a predetermined angle $\theta_1$ of inclination is in the range of 15 to 17° and a predetermined angle $\theta_2$ of inclined planes 34, 24 in a joint prominence and a joint depression is in the range of 5 to 25°.

Figure 3:
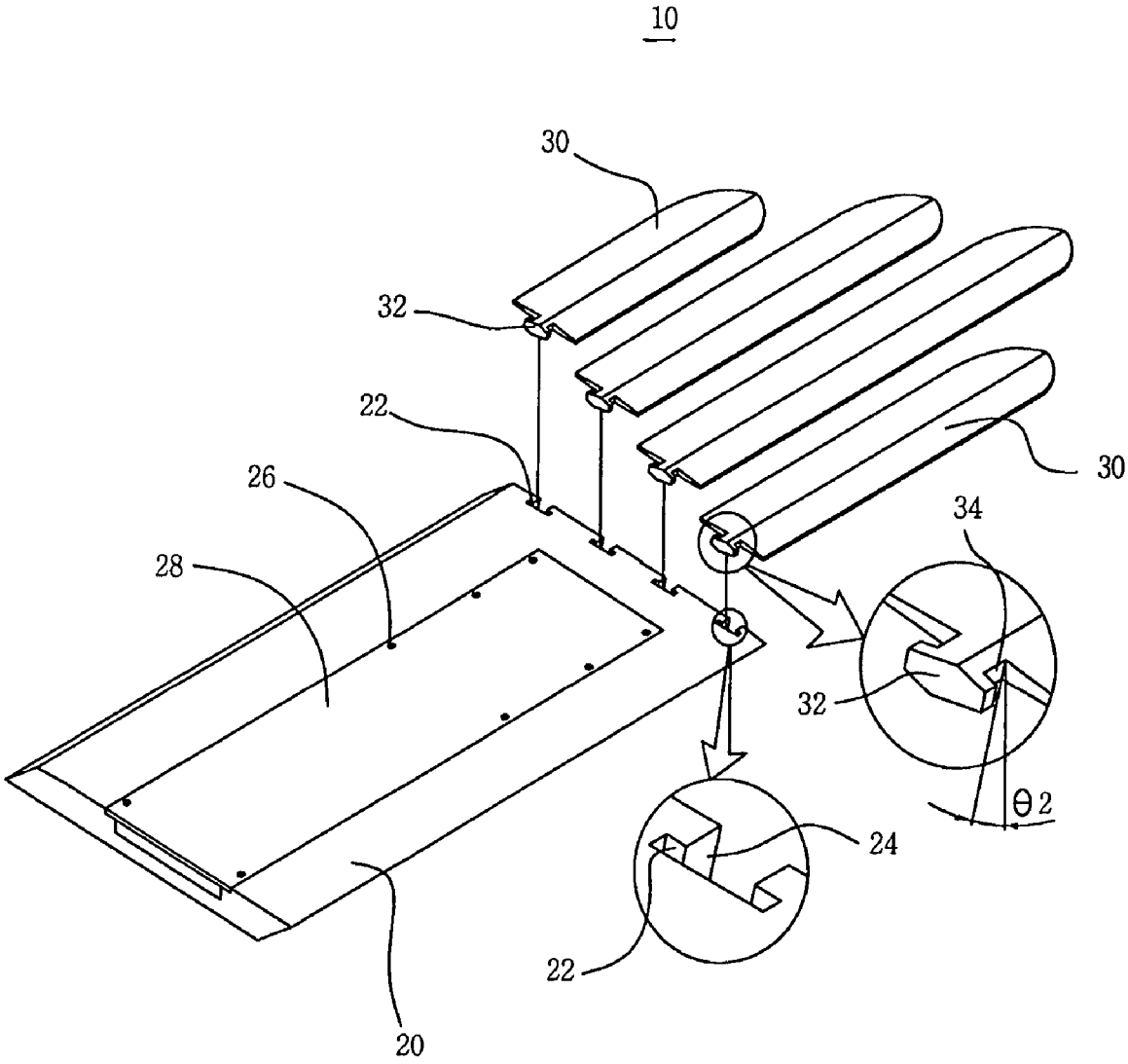
FIG. 3 is an perspective view showing a glove shaping device with its principal portions enlarged according to the present invention.
Figure 4:
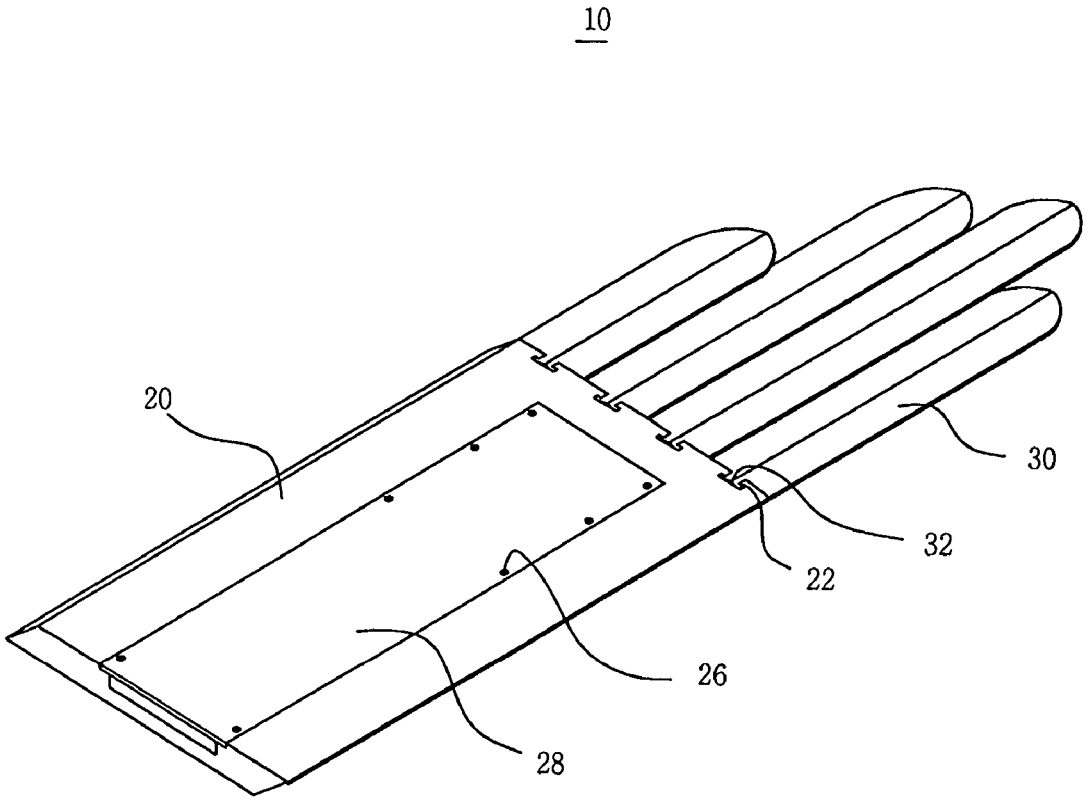
FIG. 4 is a perspective view showing a glove shaping device according to the present invention.

Refer to FIG. 3 and FIG. 4. In the figures, cover 28 is combined to upper part of a body portion 20 with screws 26.

A plurality of joint depression 22 is formed in a top portion of a body portion 20. Heating plates 30 are finger-shaped and have a rhomboid sectional shape of two parallel side surfaces each inclined at an angle of inclination $\theta_1$. And a plurality of joint prominences 32 is formed in lower ends of heating plates 30, which are expected to combine to joint depressions 22. When joint prominences 32 and joint depressions 22 are combined to each other, their combination results in firmly joining and fixing of heating plates 30 and a body portion 20 each other.

Therefore by joining and welding of a joint prominence 32 of a heating plate and a joint depression 22 of a body portion 20, heating plates 30 and a body portion 20 are united as one body of a shaping device. In the inside of body portion 20, an electric heater is provided, and then is shielded by cover 28 to avoid exposure to surroundings.

Figure 5:
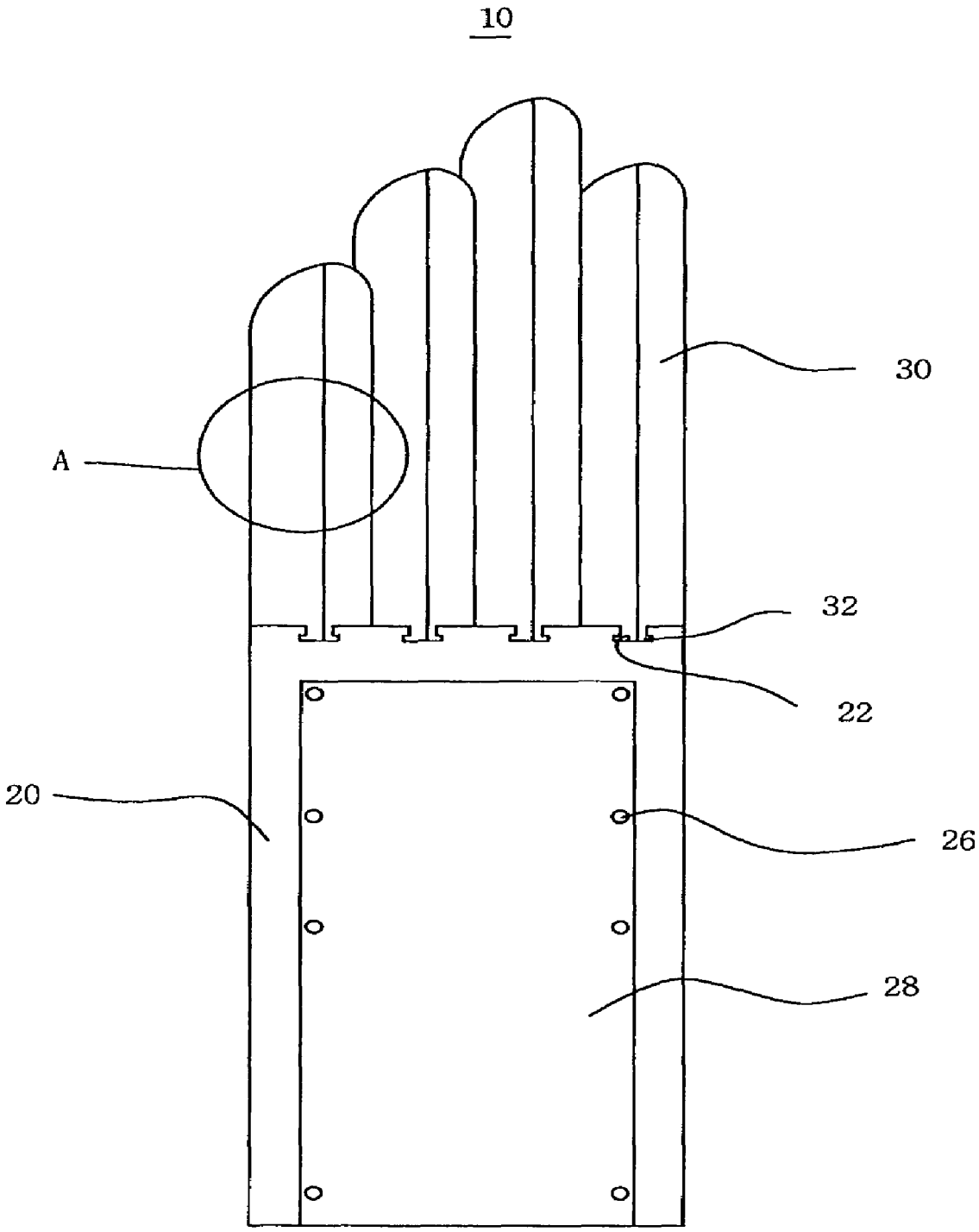
FIG. 5 is a plan view showing a glove shaping device according to the present invention.
Figure 6:
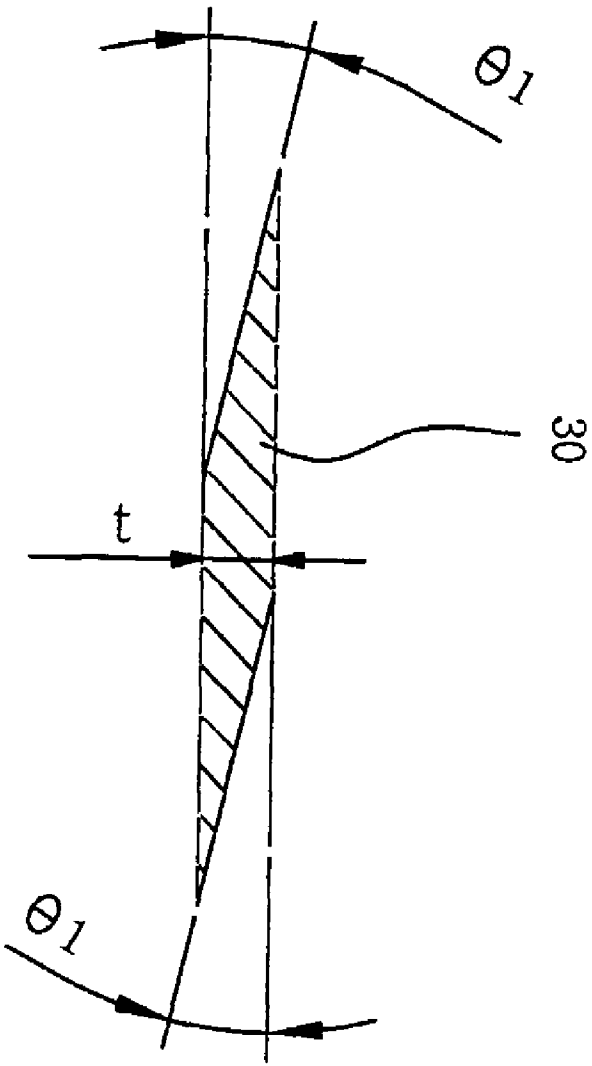
FIG. 6 is an enlarged cross section of portion "A" of FIG. 5.

Referring to FIGS. 5 and 6, each of the heating plates is formed to have a rhomboid sectional shape, a predetermined thickness t, and two parallel side surfaces each inclined at a predetermined angle $\theta_1$. A predetermined thickness is preferably 8 mm.

Figure 7:
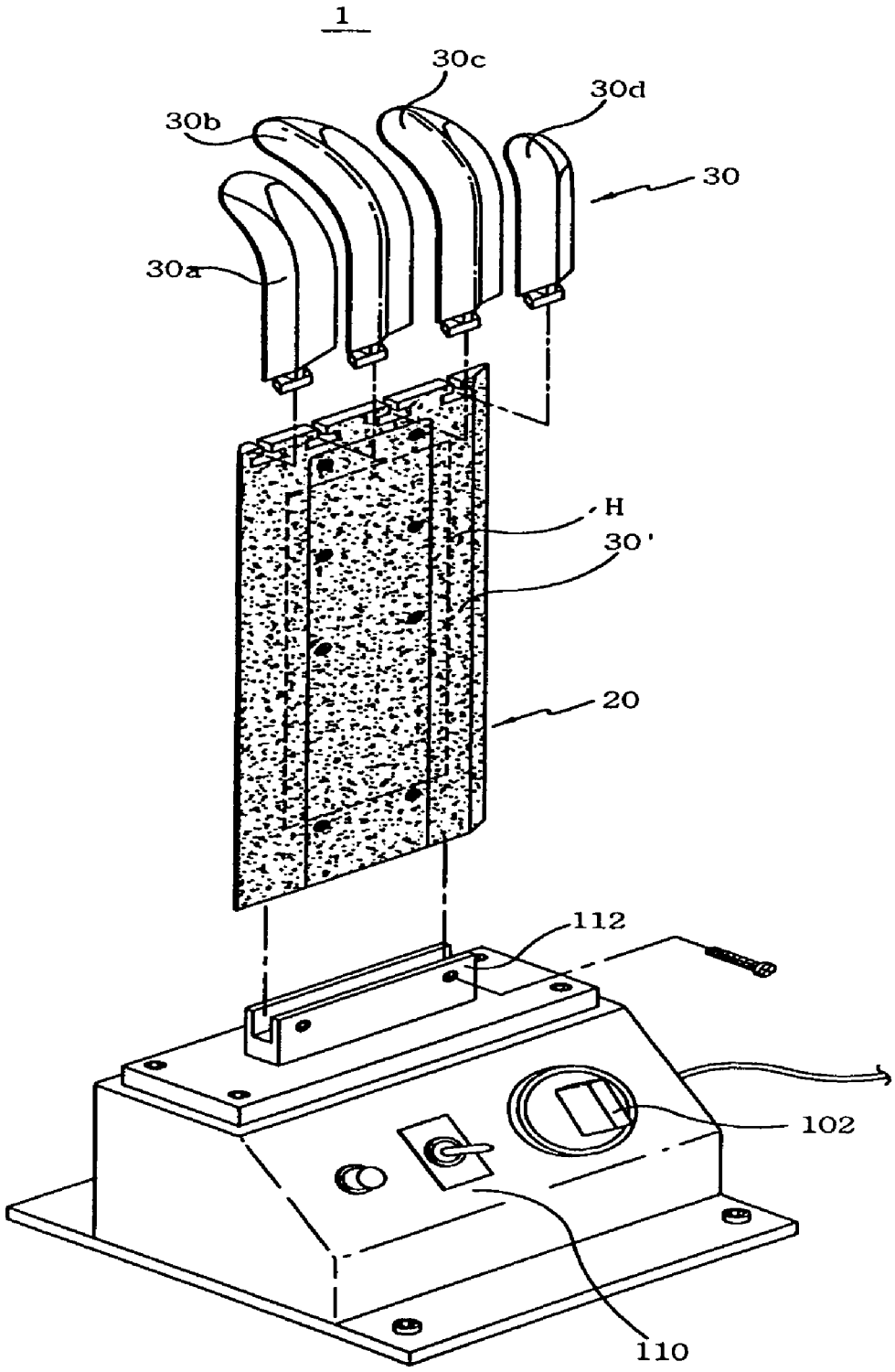
FIG. 7 is an perspective view showing another glove shaping device in accordance with another embodiment of the present invention.

Referring FIG. 7, another embodiment of the present invention provides a glove shaping device. A glove shaping device for heating and shaping wrinkled and sewn portions of a glove comprise heating plates 30 consist of the first heating plate 30*a*, the second heating plate 30*b*, the third heating plate 30*c* and the fourth heating plate 30*d* which have rounded-shapes being curved to one side with a predetermined curvature at their top portions; a body portion 20 provided in its interior with an electric heater H; a cover 28; a control unit 110 with a temperature control lever 102; and a fixing unit 112 placed on a top portion of a control unit 110.

In heating plates, since grooves 30*e* are formed in the first heating plate 30*a*, the second heating plate 30*b*, the third heating plate 30*c* and the fourth heating plate 30*d* respectively, spaces 30*f* are formed between two of heating plates according to being formed grooves 30*e*.

Since there are still overheating problems in a shaping device it is preferable to form a coating layer 30' on said heating plate and said body portion so as to prevent the material from adhering to the heating plates 30 due to excess heat.

Figure 8:
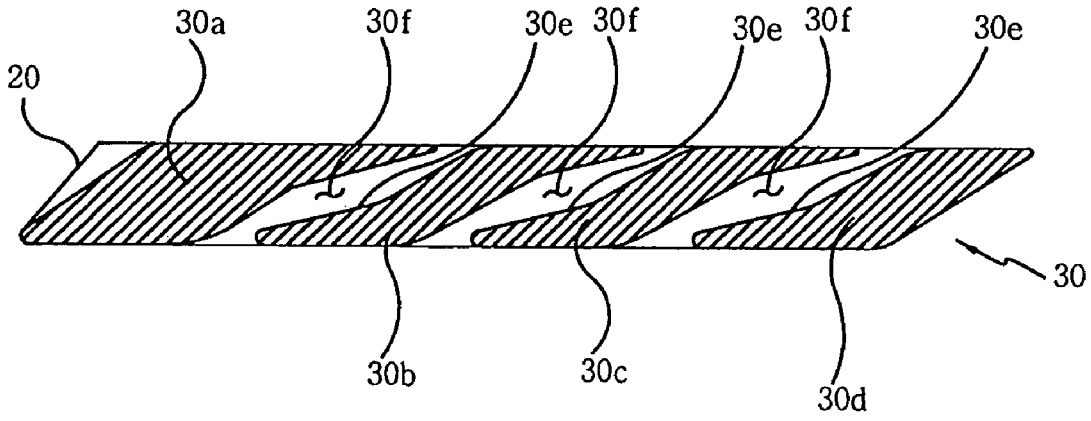
FIG. 8 is enlarged cross section showing a principal portion of another glove shaping device in accordance with another embodiment of the present invention.

An enlarged cross section showing a principal portion of heating plates 30 is shown in FIG. 8, comprising the first heating plate 30*a*, the second heating plate 30*b*, the third heating plate 30*c*and the fourth heating plate 30*d*, arranged sequentially side by side. Advantageously, the first heating plate 30*a*, the second heating plate 30*b*, the third heating plate 30*c* and the fourth heating plate 30*d*, are sequentially arranged and aligned, on opposed sides thereof, advantageously generally along common parallel planes, as depicted in FIG. 8. Grooves (concavities) 30*e*, for example of angular configuration as shown in FIG. 8, fanned in each of remaining sides which oppose an adjacent one of the heating plates 30*a*30*b*, 30*c*, 30*d*, define spaces 30*f* between each adjacent pair of the heating plates 30*a*, 30*b*, 30*c*, 30*d*, thereby creating an enlarged gap between adjacent ones of the heating plates 30*a*, 30*b*, 30*c*, 30*d*.

In the structural example shown in FIG. 8 satisfying the above conditions, each of the heating plates 30*a*, 30*b*, 30*c*, 30*d* assumes a cross sectional shape obtained by modification of a generally rhomboid (rhombus) shape, specifically by augmentation of at least one corner region. First heating plate 30*a* is defined, shape-wise in cross section, by an outer perimeter formed by a generally rhomboid (rhombus) cross sectional shape which is modified by the addition of a generally triangular portion bounded by a linear extension of a side of the cross sectional shape adjacent an acute angular corner thereof proximate to the second heating plate 30*b*, extended in a direction of the second heating plate 30*b*. and a line segment extending from a terminal end of the linear extension which meets the remaining side adjacent to said acute angular corner. As such, the first heating plate has a general cross sectional shape of a rhomboid (rhombus) with the addition of a protruding triangular portion at an acute angle corner facing the second heating plate.

Each of the second and third heating plates 30*b*, 30*c* is defined, shape-wise in cross section, by an outer perimeter formed by a generally rhomboid (rhombus) cross sectional shape modified by linear extensions of two opposed sides of the cross sectional shape adjacent both acute angle corners thereof in a direction of the two adjacent heating plates 30*a*, 30*c* and 30*b*, 30*d*, respectively, and corresponding line segments extending from a terminal end of each of the linear extensions which intersect the remaining sides adjacent to respective ones of the acute angle corners.

Lastly, the fourth heating plate 30*d* is defined, shape-wise in cross section, in a manner analogous with the first heating plate 30*a*, described above. In this case, however, the triangular corner addition is directed towards the third heating plate 20*c* as a linear extension of a side of the cross sectional shape adjacent an acute angular corner thereof (opposite to the side of the first hearing plate 30*a*which is extended) proximate to the third heating plate 30*c* in a direction of the second heating plate 30*c*, and a line segment extending from a terminal end of the linear extension which intersects the remaining side adjacent to said acute angular corner.

The use of the glove shaping device of the present invention is described in more detail.

Referring to FIGS. 3 to 6, in order to shape a cut and sewn glove using the glove shaping device 10, firstly a joint prominence 32 of a heating plate is joined to a joint depression 22 of a body portion 20 and the joint region is welded to firmly combine each other.

In this step, a joint prominence 32 in a heating plate 30 and a joint depression 22 in a body portion 20 are formed with corresponding inclined planes 34, 24 at a predetermined angle $\theta_2$ respectively. Therefore after combination, a joint prominence 32 and a joint depression 22 are not so easy to separate from each other. Moreover a grinding process is carried out for the welded part so as not to show the welded part from outside.

In this case, a predetermined angle θ2 is in the range of 5 to 25°.

After assembling of a glove shaping device 10, the heating plates 30 are closely inserted into the finger portions of the cut and sewn glove.

In such a state, when power is supplied to the electric heater provided in the main body 20, the heating plates 30 are heated to a certain temperature by the electric heater. The temperature of the heating plates 30 is adjusted by a control unit 110.

When the material of a glove is leather, the temperature of the heating plates 30 is adjusted to about 70 to 80° C. Further, when the material of a glove is textile, the temperature of the heating plates 30 is adjusted to about 150° C., and the heating time is about 10 to 20 sec.

As described above, when the heating plates 30 are heated by the electric heater H, the finger portions of the glove closely fitted onto the heating plates 30 are heated and shaped. Accordingly, the wrinkled and sewn portions of the glove are desirably shaped, thereby allowing the glove to have a desirable shape.

In this case, the above-described heating plate 30 is provided with the side surfaces each inclined at an angle of $\theta_1$, so the heating plates 30 are easily inserted into the finger portions of the glove, and also a gap having a given size is formed between two neighboring heating plates 30 by the neighboring inclined side surfaces.

Therefore, while the glove is heated and shaped, overheating resulting from contact between the finger portions of glove is prevented. Further, the finger portions of the glove heated while being fitted on the above heating plates 30 are shaped in the same thickness t (about 8 mm) as the heating plate, so the glove can maintain the thickness t after being shaped. Accordingly, when a user wears the glove, the glove closely fits on his hand.

In this case, the predetermined thickness t of each of the heating plates is about 8 mm and the predetermined angle $\theta_1$ is in the range of 15 to 17°.

Referring to FIGS. 7 and 8, another preferred embodiment provided in the present invention is used, which has heating plates 30 of a shaping device 10 with rounded-shapes being curved to one side with a predetermined curvature at their top portions resulting in maintaining a rounded-shape of the glove after being shaped.

In the process of heating and shaping, since a portion of glove (a wrist of a glove) made of synthetic fiber can not resist a relatively high temperature, it adheres to the surface of heating plates 30 heated up to the temperature to shape the material of leather (about 70 to 80° C.) or the material of textile (150° C.).

In order to avoid the problem, in a glove shaping device according to the present invention, a coating layer 30' is formed on the surfaces of heating plates 30 and a body portion 20. Accordingly at the suitable temperature to shape a glove, the material of a glove does not tightly adhere to the heating plates, or a deformation does not occur.

As described above, when the wrinkled and sewn portions of the glove fabricated by cutting and sewing are heated and shaped using the glove shaping device of the present invention, the adjustment of a heating temperature is easy and convenient, and the thickness of the shaping device is minimized. Accordingly, the costs of manufacturing the glove shaping device can be reduced, and a shaping operation can be easily performed. As a result, the occurrence of inferior products can be reduced and the productivity of a glove manufacturing process can be improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A glove shaping device, comprising:

a body portion including an electric heater disposed in an interior thereof; and a first heating plate, a second heating plate, a third heating plate and a fourth heating plate attached to the body portion, each of the heating plates assuming a cross sectional shape obtained by modification of a generally rhomboid or rhombus shape by augmentation of at least one corner region;

said first heating plate being defined, shape-wise in cross section, by a first outer perimeter formed by the generally rhomboid or rhombus cross sectional shape which is modified by addition of a generally triangular portion bounded by a linear extension of a side of the cross sectional shape adjacent an acute angular corner thereof proximate to the second heating plate, extended in a direction of the second heating plate, and a line segment extending from a terminal end of the linear extension which meets the remaining side adjacent to said acute angular corner;

said second and third heating plates being defined, shape-wise in cross section, respectively by second and third outer perimeters each formed by a generally rhomboid or rhombus cross sectional shape modified by linear extensions of two opposed sides of the cross sectional shape adjacent both acute angle corners thereof in a direction of two adjacent heating plates, respectively, and corresponding line segments extending from a terminal end of each of the linear extensions which meet the remaining sides adjacent to respective ones of the acute angle corners;

said fourth heating plate being defined, shape-wise in cross section, by a fourth outer perimeter formed by the generally rhomboid or rhombus cross sectional shape which is modified by addition of a fourth generally triangular portion bounded by a linear extension of a side of the cross sectional shape adjacent an acute angular corner thereof proximate to the third heating plate, extended in a direction of the third heating plate, and a line segment extending from a terminal end of the linear extension which meets the remaining side adjacent to said acute angular corner.

2. The glove shaping device according to claim 1, wherein a coating layer is formed on said heating plates and said body portion.

* * * * *

UNITED STATES PATENT AND TRADEMARK OFFICE

CERTIFICATE OF CORRECTION

PATENT NO. : 7,281,645 B2
APPLICATION NO. : 10/522379
DATED : October 16, 2007
INVENTOR(S) : Chang-Yul Cho It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 213 days.

Delete the phrase "by 213 days" and insert -- by 362 days --

Signed and Sealed this

Twenty-second Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,281,645 B2
APPLICATION NO. : 10/522379
DATED : October 16, 2007
INVENTOR(S) : Chang-Yul Cho It is certified that error appears in the above-identified patent and that said Letters Patent is hereby corrected as shown below:

The Certificate of Correction issued June 22, 2010 displaying the correction:
"On the Title Page,
[*] Notice: Subject to any disclaimer, the term of this patent is extended or adjusted under 35 U.S.C. 154(b) by 213 days.
Delete the phrase "by 213 days" and insert --by 362 days-- was issued in error. The patent term information does not correspond to the information in the printed patent. The incorrect patent information was entered in the heading of the Certificate of Correction. The [*] Notice in Patent No. 7,281,645 should read:

--[*] Notice: Subject to any disclaimer, the term of this patent is extended or adjusted under 35 U.S.C. 154(b) by 34 days.--

This certificate supersedes the Certificate of Correction issued June 22, 2010.

Signed and Sealed this

Twentieth Day of July, 2010

David J. Kappos

David J. Kappos
*Director of the United States Patent and Trademark Office*